US005345068A

United States Patent [19]

Hatano et al.

[11] Patent Number: 5,345,068

[45] Date of Patent: Sep. 6, 1994

[54] COOKING OVEN WITH ROTATABLE AND HORIZONTALLY MOVABLE TURNTABLE

[75] Inventors: Hideaki Hatano, Kashiwa; Hiroichiro Watanabe, Ushiku; Akio Hotta, Kashiwa; Motohiro Kuroki, Tsukuba, all of Japan

[73] Assignee: Hitachi Hometec, Ltd., Chiba, Japan

[21] Appl. No.: 49,438

[22] Filed: Apr. 20, 1993

[30] Foreign Application Priority Data

| | | | |
|---|---|---|---|
| Apr. 20, 1992 | [JP] | Japan | 4-99498 |
| Apr. 20, 1992 | [JP] | Japan | 4-99499 |
| Mar. 9, 1993 | [JP] | Japan | 5-47033 |

[51] Int. Cl.[5] ..... H05B 6/68

[52] U.S. Cl. ..... 219/722; 219/518; 219/754; 219/763; 219/708; 99/325

[58] Field of Search ..... 219/10.55 B, 10.55 F, 219/10.55 E, 518, 10.55 C, 722, 723, 739, 754, 763, 708; 99/325

[56] References Cited

U.S. PATENT DOCUMENTS

| | | | |
|---|---|---|---|
| 4,335,292 | 6/1982 | Tanaka et al. | 219/754 |
| 4,424,431 | 1/1984 | Gurubatham | 219/754 |
| 4,539,455 | 9/1985 | Colato et al. | 219/755 |
| 5,097,106 | 3/1992 | Arai et al. | 219/754 |
| 5,117,079 | 5/1992 | Morino et al. | 219/754 |

FOREIGN PATENT DOCUMENTS

| | | |
|---|---|---|
| 56-20931 | 2/1981 | Japan . |
| 57-84588 | 5/1982 | Japan . |
| 58-24618 | 2/1983 | Japan . |
| 58-120411 | 8/1983 | Japan . |
| 2-161214 | 6/1990 | Japan . |
| 3-37315 | 4/1991 | Japan . |
| 4-57108 | 5/1992 | Japan . |

*Primary Examiner*—Philip H. Leung
*Attorney, Agent, or Firm*—Bacon & Thomas

[57] ABSTRACT

A cooking oven is provided with a weight detection unit for detecting the weight of a cooking object placed on a turntable. The turntable is movable into and out of a heating chamber associated with the cooking oven by means of a moving unit drivingly connected to the turntable through a lever and connecting rod. A heater and a rotary drive unit for rotating a table upon which the turntable is mounted are controlled according to a signal from the weight detection unit. The cooking oven is also provided with an external input unit for supplying data on the heating operation and on the driving of the turntable. Either manual or automatic operation of moving the turntable back and forth can be selected according to a signal from the external input unit. The cooking oven is further provided with a detection unit for detecting the opening and shutting of its door and a control unit which functions to control the movement of the turntable into and out of the heating chamber commensurate with the opening and the shutting of the door in accordance with a signal from the detection unit for detecting the opening and shutting of the door.

9 Claims, 3 Drawing Sheets

COOKING OVEN WITH ROTATABLE AND HORIZONTALLY MOVABLE TURNTABLE

BACKGROUND OF THE INVENTION

1. Field of the Invention

The present invention relates to a cooking oven capable of rotating a turntable with a cooking object placed thereon, of moving the turntable into and out of a heating chamber, of determining the time required for the object to be heated in agreement with its weight, and of controlling the way of moving the turntable.

2. Description of the Related Art

As shown in FIG. 1, a conventional cooking oven (Japanese Patent Laid-Open No. 161214/1990) includes a heating chamber 1 for accommodating an object to be heated, a door 2 which can be opened and shut, the door being fitted to the front of the cooking oven, and a moving means 18 provided with a motor 19 for rotating a turntable 3 on the base of the heating chamber 1 and a moving unit 20. Consequently, the turntable 3 can be loaded on the top surface of the moving means 18 before being moved, together with the moving means 18, by the moving unit 20 into and out of the heating chamber 1.

When cooking, food is placed on the turntable 3 and the door 2 is shut. Then the food is cooked by means of a microwave or electrical heating. It has also been arranged that the turntable 3 can be rotated by the motor 19 during the cooking operation and can be moved by the moving unit 20 into and out of the heating chamber 1. In this way, an object to be heated is readily placed into and out of the heating chamber 1.

However, the conventional cooking oven, as described above, is what has incorporated the turntable 3, the motor 19 and the moving unit 20 into the moving means 18. As a result, lead wires for use in supplying power to the motor 19 and the moving unit 20 have been so arranged that they are long enough to be proportional to the movement of the turntable 3 or otherwise that there is employed a special reinforced lead wire capable of withstanding the stress resulting from the movement.

When a microwave energy is used as heating means, the motor 19 of the turntable 3, the moving unit 20 and the like are irradiated with a microwave and the microwave irradiation may cause a spark, abnormal heating and the like, thus interfering with the cooking operation. When the microwave is propagated outside the heating chamber 1 with the lead wire as an antenna, a control unit may be heat-damaged thereby or caused to malfunction because of high-frequency noise. The disadvantage is that the microwave is not usable as such a heating means, that is, the dangers enumerated above limit such heating means for use to electric heaters.

Moreover, the moving means 18 incorporating the turntable 3 together with the motor 19 for rotating the turntable 3 and the moving unit 20 may be hindered from smoothly moving back and forth because of smoke black resulting from cooking and sticking to the moving means 18, because of waste food and of liquid infiltration. When any one of the essential mechanical parts is soiled, it is infeasible to take away such a part for washing and this tends to lower not only its cleanliness but also its sanitary conditions. The system as a whole is disadvantageous in that it is apt to become thus large-scaled and costly and besides a large exposed hot portion is tantamount to suffering from a possible burn.

Japanese Utility Model Unexamined Publication No. Hei 4-57108 proposes a cooking oven designed to facilitate placing and replacing a cooking object in a heating chamber by interlocking the movement of a turntable with that of its door in addition to rotating the turntable by means of a drive unit.

However, the cooking oven proposed above is disadvantageous for automatic cooking as the load of the object placed on the turntable is supported with the bottom of the heating chamber and cannot be weighed. Since the movement of the turntable is interlocked with that of the door, moreover, the speed at moving the turntable into and out of the heating chamber is affected by the speed at which the door is opened and shut; consequently, the former tends to vary. The variation of the speed may cause unstable bowls such as bottles and cups to topple down or may cause a cooking object to fall over by the shock produced at the time the door is opened or shut or may cause what is liquid to spill. In other words, there is the risk of burning oneself when such an object is hot.

Moreover, the object is taken out each time the door is opened and this may lower its temperature even when it is only needed to check the cooking result without taking it out. The problem is that the freedom of taking the object in and out is lacking.

Since the turntable is coupled to a member for coupling the door, the rear side of the turntable with a receiving tray remains inside the heating chamber even when the door is opened. When a liquid substance is accidentally spilt, it has been very difficult to clean not only the turntable with the receiving tray but also its rear side as well as the bottom surface of the heating chamber. Moreover, the moving distance of the turntable is determined by the length of the coupling member, which has to be made longer as a portion to be taken out increases. In this case, the coupling member may become an obstacle while the object is taken in and out. The joint between the coupling member and the coupling part of the turntable corresponds to a shaft for use in opening and shutting the door and makes an arcuate locus while the door is opened and shut. In other words, the turntable is caused to move back and forth while it is moved up and down. As a result, the coupling member cannot be made much longer to decrease the vertical movement of the turntable. The problem in this case is that the longitudinal movement of the turntable is restricted.

A cogwheel for rotating the turntable and the cogwheel of the drive unit are engaged with and released from each other each time the door is opened and shut. Therefore, these cogwheels are apt to wear rapidly and when the door is quickly shut, they are forced to strike against each other; consequently, there arise various problems therefrom including the damage of the cogwheels, the deformation of the shaft and so forth.

SUMMARY OF THE INVENTION

An object of the present invention is to solve the above-described problems accompanying the above related art.

In order to solve the foregoing problems, a cooking oven according to the present invention comprises a heating chamber, a door for opening and closing the heating chamber, a turntable which can be moved into and out of the heating chamber, a heating means for heating a cooking object placed on the turntable, a rotary means for rotating the turntable, a transfer means for moving the turntable inside and outside, a weight detection unit for detecting the weight of the object placed on the turntable, an external input unit for supplying data on the heating operation of the heating means and the driving of the turntable as occasion demands, the manual or automatic operation of moving the turntable back and forth being selected according to a signal from the external input unit, a detection unit for detecting the opening and shutting of the door, and a control means which functions as what optionally controls the movement of the turntable into and out of the heating chamber interlockingly with the opening and shutting of the door as occasion demands, the transfer means having a moving unit, a lever, and a coupling rod.

With this arrangement, the weight detection unit operates to detect the weight of the object placed on the turntable, the external input unit to supply data on the heating operation and on the driving of the turntable, and the detection unit to detect the opening and shutting of the door. Further, the control means operates to control the heating means and the rotary means according to a signal from the weight detection unit, to select either manual or automatic operation of moving the turntable back and forth according to a signal from the external input unit, and to optionally move the turntable into and out of the heating chamber interlockingly with the opening and shutting of the door as occasion demands according to a signal from the detection unit for detecting the opening and shutting of the door. When the automatic operation is performed, for example, control is exercised so that the lever is driven by the moving unit to push the coupling rod so as to move the turntable into and out of the heating chamber.

Further, in order to solve the foregoing problems, a cooking oven according to the present invention is provided with a special moving means, whereby a cooking object placed on a turntable can be taken in and out selectively at a desired speed. In this case,a drive unit for moving the moving means is installed outside a heating chamber and part of the drive unit is moved into and out of the heating chamber only when required to be thus moved. The provision of the turntable and a rotary means which are detachable from the cooking oven make it possible to clean them with excellent efficiency and to optionally determine the moving distance of the turntable.

With the provision of the special moving means, the moving speed of the cooking object placed on the turntable can be determined optionally, irrespective of the speed at which the door is opened and shut, to ensure that even unstable vessels may smoothly travel without toppling down and are set free from being badly affected in various ways by the variation of the speed at which the door is opened and shut. Moreover, the installation of the drive unit for moving the turntable outside the heating chamber facilitates the cleaning of the turntable and the rotary means as they are detachable from the heating chamber. The installation of the drive unit for moving the turntable outside the heating chamber further makes it unrestrictive to set up a cooking system and its size. The moving distance of the turntable can thus be determined optionally without restriction, so that the safety of the cooking oven in practical use is improvable.

Still further, in order to solve the foregoing problems, a cooking oven according to the present invention comprises a heating chamber, a door for opening and closing the heating chamber, a turntable which can be moved into and out of the heating chamber, a heating means for heating a cooking object placed on the turntable, a moving means for moving the turntable, a weight detection unit for detecting the weight of the object placed on the turntable, an external input unit for supplying data on the operation of the heating means and on the driving of the turntable as occasion demands, and control means for controlling the heating means and the moving means according to signals from the external input unit and the weight detection unit. The moving means further comprises a rotary table for loading the turntable thereon and a drive unit for driving the rotary table, and operates to drive the turntable into and out of the heating chamber optionally and when the turntable remains in the heating chamber, makes rotatable the turntable together with the rotary table.

With this arrangement, the weight detection unit detects the weight of the cooking object when data on the commencement of cooking is supplied from the external input unit and the control means controls the heating operation in proportion to the weight thus measured. The turntable rotates during the heating operation so as to heat the object equally and also allows the object to be taken out of the heating chamber safely and conveniently after the cooking operation is terminated.

DETAILED DESCRIPTION OF THE PREFERRED EMBODIMENTS

Referring to the accompanying drawings, embodiments of the present invention will be described.

FIGS. 2 to 5 show a cooking oven according to one embodiment of the present invention.

Figure 1:
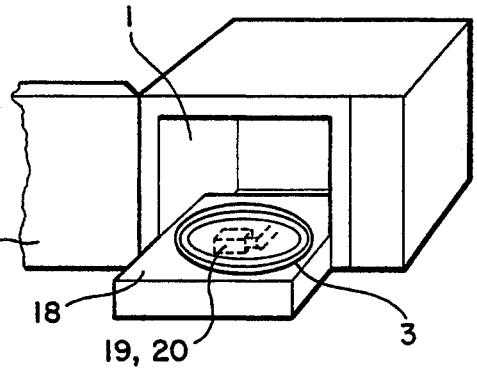
FIG. 1 (PRIOR ART)
FIG. 1 shows a diagram illustrating the principal part of a conventional cooking oven.
Figure 2:
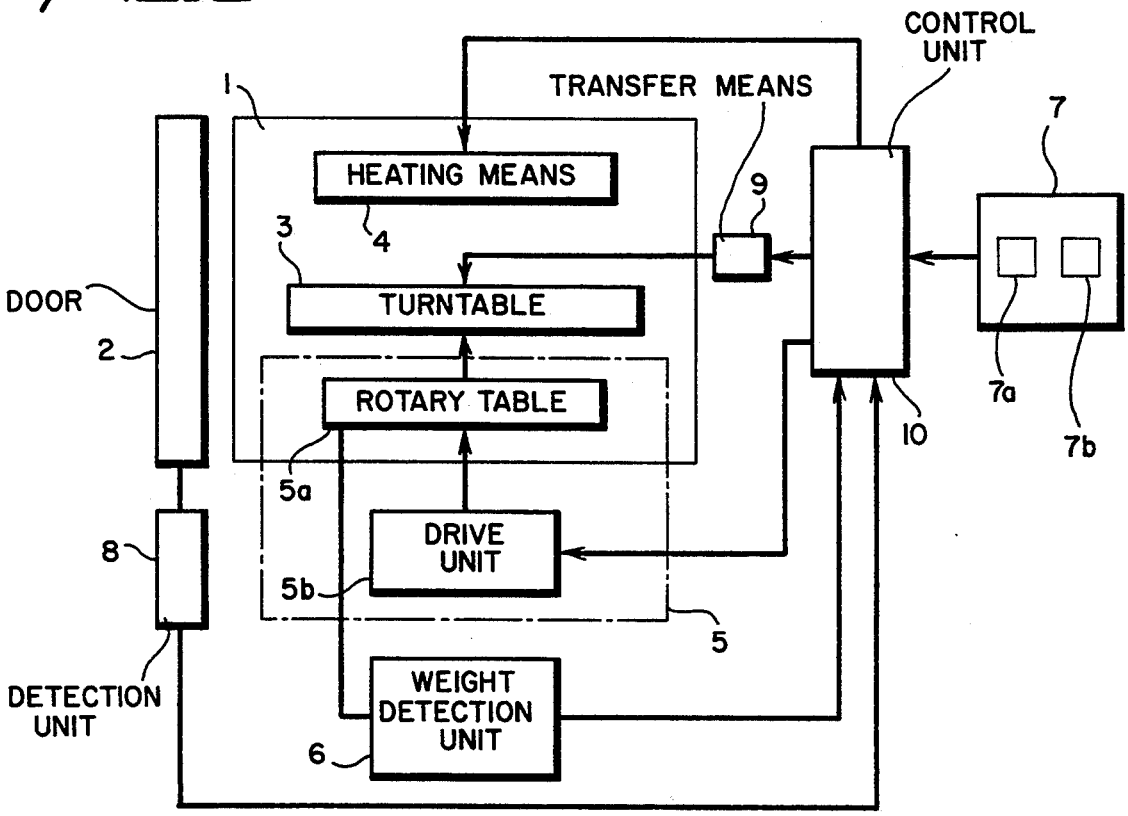
FIG. 2 shows a block diagram of a cooking oven according to one embodiment of the present invention.
Figure 3:
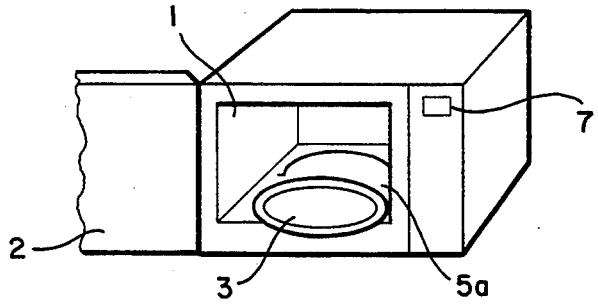
FIG. 3 shows an external perspective view of the cooking oven.

In FIG. 2, numeral reference 1 denotes a heating chamber for accommodating an object to be heated (not shown), 2 a door fitted to the front of the heating chamber 1, 3 a turntable set movable into and out of the heating chamber 1, 4 a heating means (e.g., a microwave generator, an electric heater and the like) for generating energy for heating the object in the heating chamber 1, and 5 a rotary means for rotating and moving the turntable 3 in the heating chamber 1. The rotary means 5 includes a rotary table **5*a* installed in the heating chamber 1 and a drive unit 5*b* installed outside the heating chamber 1, the rotary table 5*a* being so arranged as to be detachable from the drive unit 5*b***.

Numeral reference 6 denotes a weight detection unit installed outside the heating chamber 1 and used for weighing the object placed on the turntable 3 via the turntable 3 and the rotary table 5*a*, 7 an external input unit also installed outside the heating chamber 1 and provided with a cooking button 7*a* for use in operating the heating means 4 for heating the object and a auto/-manual switch button 7*b* for use in moving the turntable 3 into and out of the heating chamber 1, and 8 a detection unit for detecting the opening and shutting of the door 2.

Figure 4:
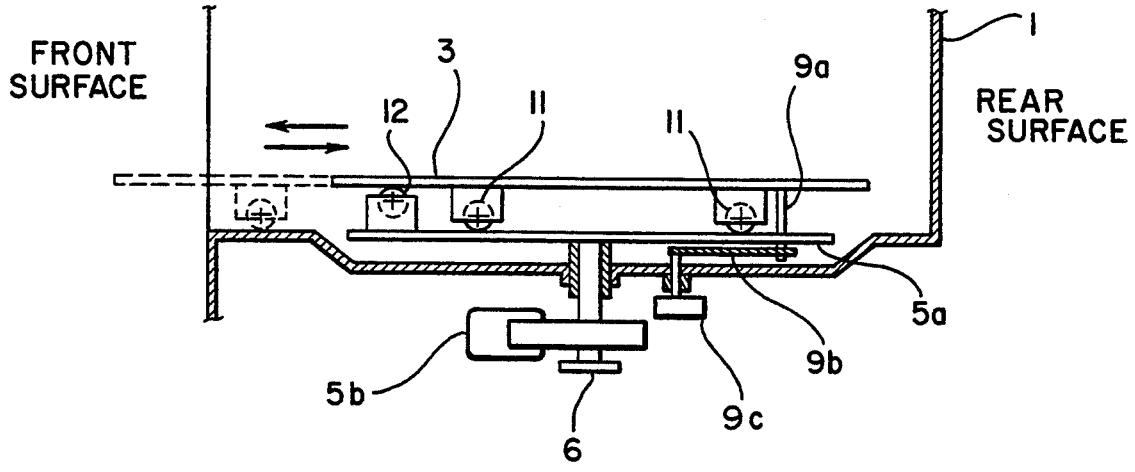
FIG. 4 shows a sectional view of the principal part of the cooking oven.
Figure 5:
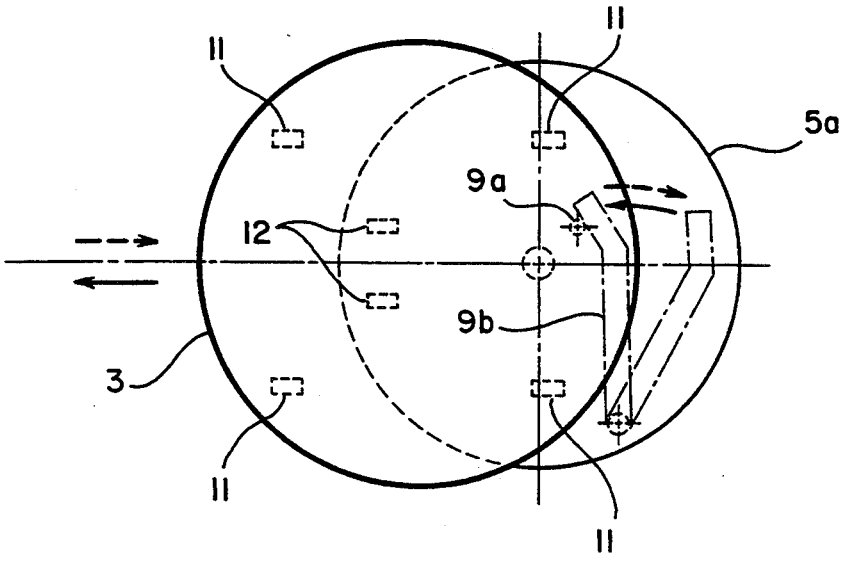
FIG. 5 shows a top view of the principal part thereof illustrating its operation.

Further, the turntable 3 is detachably loaded on the rotary table 5*a* and the turntable 3 is provided with a roller 11 as shown in FIGS. 4 and 5, whereas the rotary table 5*a* is provided with a roller 12. The turntable 3 is arranged so that it can smoothly be moved into and out of the heating chamber 1. In this case, a transfer means 9 including a connecting rod 9*a* and a lever 9*b* is used to move the turntable 3 back and forth.

Further, numeral reference 10 denotes a control unit, which may be a microcomputer, for controlling the heating means 4 depending on the kind of a cooking object, weighing the object placed on the turntable 3 through the weight detection unit 6, and determining the heating time according to a signal from the weight detection unit 6. The control unit 10 controls when to start and stop rotating the turntable 3 via the drive unit 5*b* and the rotary table 5*a*. The control unit 10 also functions as what optionally controls the movement of the turntable 3 into and out of the heating chamber 1 by driving the moving unit 9*c* of the transfer means 9 as occasion demands interlockingly with the opening and the shutting of the door 2 according to a signal from the detection unit 8 for detecting the opening and shutting of the door 2 while selecting either manual or automatic transfer operation of the turntable 3 according to a signal from the external input unit 7.

The operation of the cooking oven thus organized will subsequently be described.

First, the door 2 is opened to place a cooking object on the turntable 3 when cooking is started by means of electromagnetic waves or electric heating. Subsequently, the door 2 is shut and the cooking button 7*a* is pressed. Then the heating time required for cooking is computed in proportion to the weight of an object detected by the weight detection unit 6. Moreover, the rotary means 5 is so controlled as to be driven in agreement with the kind of the object to be heated. Further, a decision is made on whether or not the turntable 3 is rotated simultaneously with the control exercised over the operation of the heating means 4 for cooking.

When the cooking operation is terminated, the turntable 3 that has been rotated by the control unit 10 is stopped at a predetermined position in the longitudinally movable direction through a positioning means (not shown). Such a positioning means may be constituted by a calculator which determines the stop position of the turntable 3 or rotary table 5*a* on the basis of the r.p.m. thereof, or may have a detector for rotation detection. When the door 2 is opened after the auto/-manual switch button 7*b* for instructing the operation of the turntable 3 is set automatic, the moving unit 9*c* is driven by the control unit 10 according to the signal derived therefrom. When the lever 9*b* is rotated, the moving unit 9*c* is coupled to the coupling rod 9*a* secured to the turntable 3 and made to push the object placed on the turntable 3 out of the heating chamber 1. At this time, the turntable 3 is allowed to move smoothly because of the effects of the rollers 11 and 12. If the door 2 is slightly raised to close it, the turntable 3 will be returned to the heating chamber 1 in the reverse order.

While the turntable 3 is rotating, the connecting rod 9*a* and the lever 9*b* are kept apart from each other and when auto/manual switch button 7*b* of the external input unit 7 is turned to auto, both of them are coupled together, whereby the turntable 3 is allowed to rotate and to move back and forth. If the connecting rod 9*a* is made of a magnet or a clip, then the turntable 3 can be automatically moved into the heating chamber 1 due to the firm connection between the connecting rod 9*a* and the lever 9*b*. Therefore, either case where the turntable 3 is moved manually or automatically can be chosen as occasion demands.

As the turntable 3 is detachable, on the other hand, it may be taken out of the heating chamber 1 in order to remove stains resulting from cooking simply by rinsing. Another advantage is that the turntable 3 is usable as a food saucer at the same time.

When a microwave is used as the heating means 4, the provision of an adequate gap (about 5 mm) by means of the rollers 11, 12 and the like prevents the generation of a spark due to the microwave even though the turntable 3 and the rotary table 5*a* are made of metal. Since the lead wires of the drive unit 5*b* and the moving unit 9*c* are not located in the heating chamber 1, they will not be badly affected by the microwave. As a result, the heating means 4 can be either microwave or electric heater.

If the turntable 3 is equipped with a knob of resin or silicone rubber in its front part, it may be taken out easily and manually without running the risk of burning one's hands by touching the wall of the heating chamber 1 even when the whole chamber 1 is heated and used for cooking as an oven. Moreover, guides may be provided for the rotary table 5*a* or the turntable 3 utilizing the rollers 11, 12, whereby the turntable 3 is made movable in any direction, for example, in a beeline.

Figure 7:
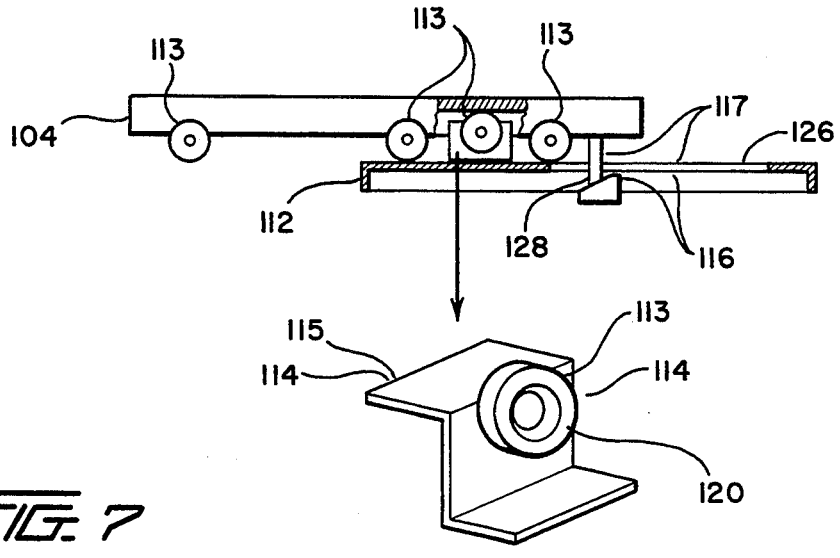
FIG. 7 shows a diagram illustrating the principal part of FIG. 6.
Figure 6:
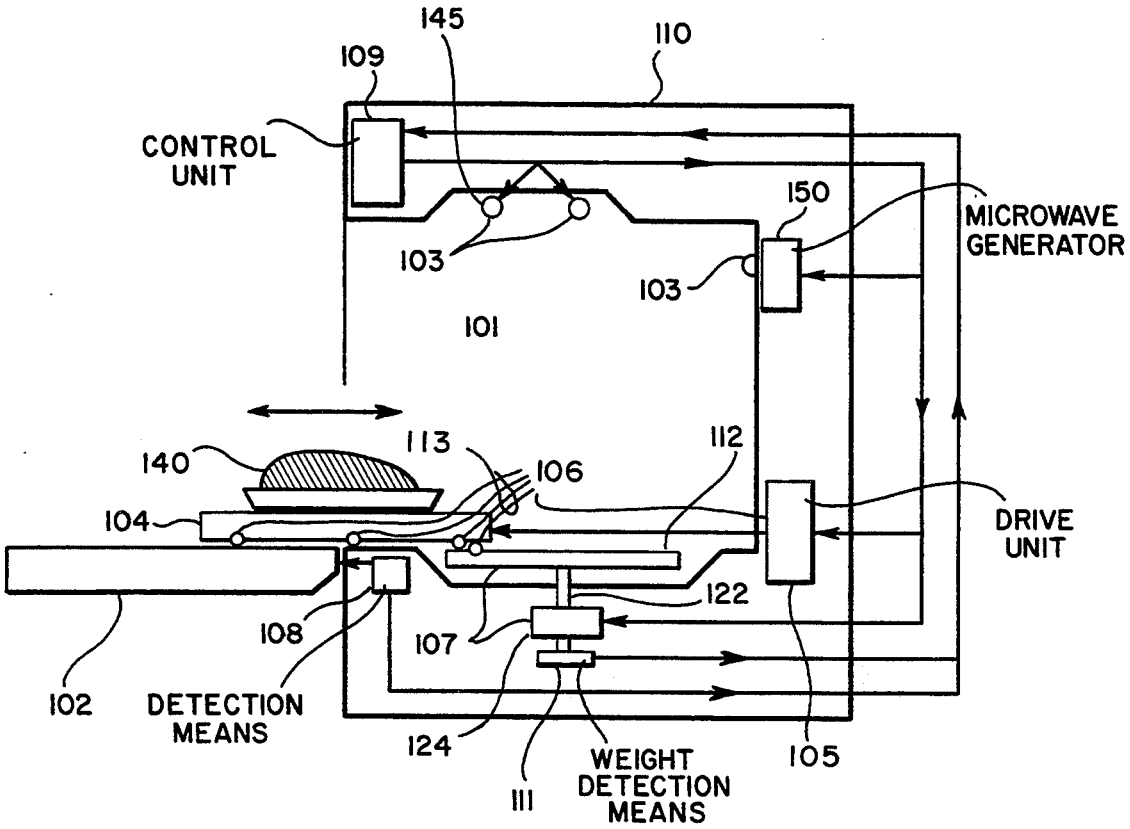
FIG. 6 shows a block diagram of a cooking oven according to another embodiment of the present invention.

FIGS. 6 and 7 show a cooking oven according to another embodiment of the present invention. In FIGS. 6 and 7, numeral reference 101 denotes a heating chamber for accommodating a cooking object 140; a door 102 which can be opened and shut being fitted to the front of the heating chamber 101; 103 a heating means for generating energy for use in heating the object in the heating chamber 101; 104 a turntable which is movable into and out of the heating chamber 101 together with the cooking object placed thereon; 105 a drive unit for rendering the turntable 104 movable into and out of the heating chamber 101; 106 a moving means including the drive unit 105; and 107 a rotary means for rotating the turntable 104 within the heating chamber 101, the rotary means 107 being positioned under the turntable 104. The turntable 104 and the rotary means 107 both are set detachable from the heating chamber 101. Further, numeral reference 108 denotes a detection means for detecting the present state of the door 102, the detection means being capable of optionally detecting an angle of the door 102 being opened or shut; 109 a control unit which may be a microcomputer for controlling the heating means 103 and the rotary means 107, depending on the kind of cooking, and for stopping the operation of the heating means 103 and also controlling the movement of the turntable 104 by means of the drive unit 105 in agreement with the angle of the door 102 being opened or shut; 110 an oven body for accommodating the control unit 109, the heating chamber 101, the door 102, the heating means 103, the turntable 104, the drive unit 105, the moving means 106, the rotary means 107 and the detection means 108; 111 a detection means for detecting the weight of the object placed on the turntable 104; and 112 a rotary table forming the rotary means 107 and loading the turntable 104 thereon. Numeral reference 145 denotes an electric heater, and 150 denotes a microwave generator.

Further, numeral reference 113 denotes rollers for smoothing the movement of the turntable 104, these rollers 113 forming part of the moving means 106; 114 a means for preventing the turntable 104 from being misloaded to ensure that it is properly loaded thereon; 115 an electromagnetic field defocusing means for preventing an electric field from concentrating on a shaft 120; 116 a means for holding a load on the turntable 104 when it is releases from the rotary table 112 in the direction of the door 102 as the turntable is moved out of the heating chamber 101; and 117 a moving guide for restricting the moving direction of the turntable 104.

With the arrangement above, the cooking oven operates as follows:

When a microwave or electric heating energy is used to start cooking food, the control unit 109 operates the detection means 108 to confirm that the door 102 is left open and then operates the drive unit 105 under its control to move the turntable 104 by a predetermined amount out of the heating chamber 101. Further, the control unit 109 allows a cooking object to be placed on the turntable 104 and operates the drive unit 105 again under its control so as to have the turntable 104 accommodated in the heating chamber 101.

When the door 102 is completely shut, the control unit 109 makes the weight detection means 111 detect the weight of the object placed on the turntable and bases it on weight data to operate the heating means 103 (e.g., a microwave generator or an electric heater) and the rotary means 107 under its control to rotate the object thereon so as to prevent unequal heating, so that the cooking operation is performed. The control unit 109 may stop the moving means 106 when the former 109 judges that the weight of the object detected by the weight detection means 111 is substantially zero, or exceeds a predetermined value.

When the door 102 is opened after the termination of the cooking operation, the detection means 108 for detecting the open state of the door 102 detects that the door 102 is completely kept open, whereas the control unit 109 operates the drive unit 105 under its control to send the turntable 104 with the cooking object placed thereon out of the heating chamber 101.

When the heating chamber 101 is cleaned, moreover, it is only needed to detach the turntable 104 and the rotary means 107 from the heating chamber 101 as they are detachable therefrom. Since the drive unit 105 of the moving means 106 is installed outside the heating chamber 101, there is nothing left on the botton portion of the heating chamber 101 except the shaft 122 of the drive motor 124 and this makes it easier to clean the inside.

The operation of rotating the turntable 104 and moving it into and out of the heating chamber 101 needs the following arrangement, for example. The rotary means 107 may have the rotary table 112 which is detachable from a shaft 122 of a drive motor 124 installed outside the heating chamber 101 and the turntable 104 loaded on the rotary table 112 is also made rotatable. The rotary means 107 may also have a plurality of rollers 113 in some parts of the turntable 104 and the rotary table 112 so as to smooth the movement of the turntable 104 on the rotary table 112. A rectangular slit 126 in a direction opposite to the door 102 may be made in part of the rotary table 112 and a guide bar 128 inserted into the slit 126 is used to form the moving guide 117 for the turntable 104. When the turntable 104 needs moving, part of the drive unit 105 installed outside the heating chamber 101 may be moved into the heating chamber 101 (provided the drive unit 105 includes a motor, a crank and a push rod in combination, for example, only the push rod is extended into the heating chamber 101 as occasion demands) in order to push and pull the turntable 104 into and out of the heating chamber 101 along the moving guide 117. However, there is no problem in both cases where the drive unit 105 is installed outside or inside the heating chamber 101. The turntable 104 may be moved into and out of the heating chamber 101 manually as occasion demands.

Incidentally, the turntable 104 and the rotary table 112 are attached to each other in the rear of the heating chamber 101, and its attaching mechanism is provided with a holding means 116 for preventing the turntable 104 from being detached from the rotary table 112 even though the turntable 104 is under an unstable state such as a slant state when the turntable 104 is moved at the side of the door 102. Moreover, the moving guide 117 is formed with the rectangular slit 126 defined in a part of the rotary table 112 and the guide bar 128 of the turntable 104 fitted in the slit 126. Therefore, since the rollers 113 provided on the rear surface of the turntable 104 are so arranged as to run on the bottom surface of the heating chamber 101 in the outer peripery of the turntable 104, the load of the turntable 104 is partially distributed from the rotary table 112 toward the bottom surface of the heating chamber 101 when the turntable 104 is moved from the rotary table 112 and moved out of the heating chamber 101. However, the roller 113 ahead of the rotary table 112 and the means 116 for holding the turntable act as those which hold the turntable 104 on the rotary table 112, thus preventing the roller 113 ahead of the turntable 104 from coming off the rotary table 112 and falling in a gap formed between the bottom surface of the heating chamber 101 and the edge portion of the rotary table 112 to ensure the smooth movement of the turntable 104. When there is the possibility of suddenly shutting the door 102 by accident in such a state that the turntable 104 has been protruded from the heating chamber 101, the means 116 for holding the turntable 104 may be arranged so that the load of the turntable 104 is used to hold the turntable 104 downward and is made separable upward. Then, the force applied to the turntable 104 upwardly is applied to the rotary table 112 and the shaft 122 of the drive motor 124 as well as the means 116 for holding the turntable are prevented from being damaged.

With respect to the heating means 103, either microwave heating or electric heating or both of them may be used for cooking purposes in accordance with a menu. Particularly when electric heating is employed in a cooking oven, the heating chamber 101 is intensely heated and if it is attempted to take the heated object manually out of the heating chamber 101 after cooking, there is the risk of burning oneself by touching the wall of the heating chamber 101. Therefore, the function of causing the cooked object to be pushed out of the heating chamber 101 according to the present invention is of great significance because the danger as previously noted can be prevented.

When the microwave heating is used for the heating means 103, electromagnetic field focusing occurs on the shaft 120 of the roller 113 in such a case where the shaft 120 is as thin as 3–4 mm and if the shaft 120, the rotary table 112 and the turntable 104 are made of metal, a spark may be produced between the shaft 120 and the rotary table 112 or the turntable 104, or otherwise they may be heated abnormally. If, however, the electromagnetic field defocusing means 115 (e.g., a 10×15 mm metal plate) is provided on the opposite side of the shaft 120, the electromagnetic field focusing will be prevented from occurring thereon. The electromagnetic field defocusing means 115 may be fitted to an effective part as occasion demands. The rollers 113 and the electromagnetic field defocusing means 115 in combination with the moving guide 117 are utilized to properly load the turntable 104 on the rotary table 112 and this combination may be used as the means 114 for preventing the turntable from being misloaded.

As set forth above, the cooking oven having the function of preventing an object from being unequally heated by rotating the object is provided with the weight detection unit for weighing the object placed on the turntable in order to control the heating and rotary means according to a signal from the weight detection unit. Since the cooking object is rotated, it is prevented from being unequally heated during the cooking operation and since it is only needed to be placed on the turntable, the heating time is made controllable in proportion to the weight of the object. As a result, the cooking oven according to the present invention is not only fit for automatic cooking but also extremely convenient for daily use.

Further, the cooking oven is provided with the external input unit for receiving and transmitting data on the heating operation, the driving of the turntable and the like, and the detection unit for detecting the opening and shutting of the door according to a signal from the external input unit which makes it possible to select either manual or automatic operation of moving the turntable back and forth. The cooking oven is also arranged so that the turntable is optionally moved into and out of the heating chamber as occasion demands interlockingly with the opening and shutting of the door according to a signal from the detection unit for detecting the opening and shutting of the door. In a case where the automatic operation is performed, the turntable with the object placed thereon is automatically pushed out of the door opened instantly after cooking is terminated, any kind of food can readily be taken in or out with the effect of decreasing the risk of burning one's hands by touching the heated chamber.

Since the lead wires of the rotary and transfer means are not located within the heating chamber, the control means is set free from abnormal heating or sparks originating from the electromagnetic waves even when the microwave is employed as the heating means. The control means is thus prevented from being damaged by overheating or abnormally operating because of high-frequency noise. The construction of the cooking oven according to the present invention may be practical in that it is prevented from malfunctioning because of the fat transferred from food and food waste sticking to the cooking oven. In addition, the cooking oven may be used with a microwave or an electric heater as the heating means and this make it possible to apply the present invention to any one of the multifunctional cooking ovens.

Since the turntable is detachable, the advantage is that it may be taken out of the heating chamber in order to remove stains resulting from cooking simply by rinsing and that it is usable as a food saucer at the same time.

As set forth above, the cooking oven according to the present invention is provided with the weight detection unit for detecting the weight of the cooking object, the external input unit capable of inputting data from the outside, and the control means for controlling the heating means and the moving means. Consequently, heating time can be control in proportion to the weight of the object only by placing the object on the turntable and giving instructions as to moving the turntable and starting the heating operation. As a result, automated cooking is made possible and this greatly improves the convenience of the user.

Moreover, the moving means is provided with the rotary table for loading the turntable thereon and the drive unit for driving the rotary table. Further, the moving means is operated to drive the turntable into and out of the heating chamber optionally and when the turntable remains in the heating chamber, to make rotatable the turntable together with the rotary table. Therefore, the cooking oven has both functions: the function of preventing uneven heating while the object is kept rotating during the cooking operation and that of preventing the user from burning himself as the chance of touching the inside of the hot chamber diminishes after the cooking operation is terminated since the moving means operates to have the food therein readily taken in and out. The cooking oven according to the present invention has been by far improved functionally.

As set forth above, the cooking object placed on the turntable is pushed out of the heating chamber as occasion demands according to the present invention. Even when the heating chamber of a cooking oven is intensely heated, the heated object can readily be taken out and the danger from burning oneself can also be avoided. Since the heated objected is pushed out of the heating chamber, this offers convenience to its user in a case where the heated object is heavy or where the cooking oven is installed at a higher place. Moreover, the cooking oven according to the present invention makes it possible to automate a series of cooking operations including cooking food and moving it into and out of the heating chamber.

Further, the drive unit for driving the turntable is not located inside the heating chamber and the electromagnetic field defocusing means is provided. Consequently, problems of sparking, abnormal heating and the like are not posed even when microwave heating is employed. In addition, the turntable and the rotary means are detachable from the heating chamber and besides the drive unit for driving the turntable are installed outside the heating chamber, whereby the heating chamber can be cleaned easily with the effect of nullifying the potential of slight injury and trouble while it is cleaned.

What is claimed is:

1. A cooking oven comprising:

a heating chamber having an opening through which an object to be cooked is taken in and out;

heating energy generating means operatively associated with said heating chamber for heating said object in said heating chamber;

a door fixed to a side of said opening of said heating chamber so as to be freely opened and shut;

a door open/close detector operatively associated with said door for detecting an open/close state of said door;

a rotary table which is rotatable and disposed on a bottom portion of said heating chamber;

a driver means connected to said rotary table for rotationally driving said rotary table;

a turntable attached on and rotatable with said rotary table and movable in a predetermined horizontal direction;

means, operatively associated with said driver means, for signalling when said rotary table is at a predetermined rotational position;

means operatively associated with said turntable for moving said turntable into and out of said heating chamber;

means operatively associated with said moving means for producing an instruction signal for stating the operation of said moving means; and a controller for controlling said driver means to stop said rotary table at said predetermined rotational position in response to a signal from said signalling means, and for controlling said moving means to move said turntable out of said heating chamber under the condition where said door open/close detector detects that said door is opened, according to said instruction signal from said producing means.

2. A cooking oven as claimed in claim 1, further comprising a weight detector, operatively associated with said turntable, for weighing the weight of said object located on said turntable.

3. A cooking oven as claimed in claim 1, wherein said moving means comprises a motor, a lever connected to said motor, and a connecting bar provided to said turntable and connectable to said lever.

4. A cooking oven as claimed in claim 1, wherein said turntable and said rotary table are detachable from each other.

5. A cooking oven as claimed in claim 1, wherein said turntable and said rotary table are detachably mounted to a part of said heating chamber opposite to said door and wherein when said turntable is moved out of said heating chamber, said turntable is separable from said rotary table thereunder.

6. A cooking oven as claimed in claim 1, further comprising a roller provided on at least one of said turntable and said rotary table for smoothly moving said turntable into and out of said heating chamber.

7. A cooking oven as claimed in claim 1, wherein said heating energy generating means generates an electromagnetic field and said oven further comprises electromagnetic field defocusing means provided on at least one of said turntable and said rotary table.

8. A cooking oven as claimed in claim 1, further comprising guide means connecting said turntable and said rotary table so that said turntable is movable on said rotary table in a predetermined horizontal direction.

9. A cooking oven as claimed in claim 8, further comprising holding means for preventing said turntable from being detached from said rotary table when said turntable moves out of said heating chamber;

wherein said guide means is connected to said turntable and said rotary table in the rear of said heating chamber.

* * * * *